US011647790B2

(12) United States Patent
Habicht et al.

(10) Patent No.: US 11,647,790 B2
(45) Date of Patent: May 16, 2023

(54) VAPORIZER POD SYSTEMS

(71) Applicant: SV3, LLC, Phoenix, AZ (US)

(72) Inventors: Geoff Habicht, Phoenix, AZ (US); Amir Hakak, Phoenix, AZ (US)

(73) Assignee: SV3, LLC, Phoenix, AZ (US)

( * ) Notice: Subject to any disclaimer, the term of this patent is extended or adjusted under 35 U.S.C. 154(b) by 220 days.

(21) Appl. No.: 16/850,398

(22) Filed: Apr. 16, 2020

(65) Prior Publication Data

US 2020/0329773 A1 Oct. 22, 2020

Related U.S. Application Data

(60) Provisional application No. 62/835,416, filed on Apr. 17, 2019.

(51) Int. Cl.

| | |
|---|---|
| ***A24F 40/10*** | (2020.01) |
| ***A24F 40/42*** | (2020.01) |
| ***A24F 40/485*** | (2020.01) |
| ***B67D 7/02*** | (2010.01) |

(52) U.S. Cl.

CPC ..... *A24F 40/485* (2020.01); *A24F 40/10* (2020.01); *A24F 40/42* (2020.01); *B67D 7/0294* (2013.01)

(58) Field of Classification Search

CPC ..... A24F 40/10; A24F 40/485; A61M 11/042; A61M 2205/125; A61M 2205/8206; A24D 3/17

See application file for complete search history.

(56) References Cited

U.S. PATENT DOCUMENTS

| | | | | |
|---|---|---|---|---|
| 5,470,511 | A * | 11/1995 | Laybourne | A61M 16/183 128/204.12 |
| 8,925,555 | B2 * | 1/2015 | Monsees | A24F 42/60 131/194 |
| 10,206,428 | B2 * | 2/2019 | Thorens | A24F 40/40 |
| 10,244,790 | B1 * | 4/2019 | Christie | A24F 7/04 |
| 10,869,507 | B2 * | 12/2020 | Zheng | A24F 40/48 |
| 11,000,072 | B2 * | 5/2021 | Xu | A24F 40/30 |
| 11,191,303 | B2 * | 12/2021 | Fu | H05B 3/44 |
| 11,219,245 | B2 * | 1/2022 | Liu | A24F 40/40 |
| 11,253,002 | B2 * | 2/2022 | Zhang | A24F 40/485 |
| 2018/0242644 | A1 * | 8/2018 | Bessant | H05B 3/34 |
| 2018/0343920 | A1 * | 12/2018 | Sutton | A24F 40/30 |
| 2019/0166913 | A1 * | 6/2019 | Trzecieski | A61M 15/06 |
| 2020/0022413 | A1 * | 1/2020 | Zhang | A24F 40/485 |
| 2020/0077704 | A1 * | 3/2020 | Ouyang | A61M 11/042 |
| 2020/0138113 | A1 * | 5/2020 | Rosser | A61M 11/042 |
| 2020/0221778 | A1 * | 7/2020 | Trzecieski | A24F 40/10 |
| 2020/0383382 | A1 * | 12/2020 | Yu | A24F 42/80 |
| 2021/0368868 | A1 * | 12/2021 | Trzecieski | A24F 40/485 |
| 2022/0030942 | A1 * | 2/2022 | Lord | A24F 40/44 |

* cited by examiner

*Primary Examiner* — Abdullah A Riyami
*Assistant Examiner* — Thang H Nguyen
(74) *Attorney, Agent, or Firm* — Snell & Wilmer L.L.P.

(57) ABSTRACT

A vaporizer pod is disclosed. In various embodiments, the vaporizer pod comprises a reservoir defined by, and disposed within a housing, wherein the housing defines a central channel extending between a central channel inlet and a central channel outlet, a column disposed within the housing, an atomizer channel extending between an atomizer channel inlet and an atomizer channel outlet, and a heat conductor disposed within the column.

12 Claims, 14 Drawing Sheets

VAPORIZER POD SYSTEMS

CROSS REFERENCE TO RELATED APPLICATION

This application is based on and derives the benefit of the filing date of U.S. Provisional Application No. 62/835,416 filed on Apr. 17, 2019 entitled "VAPORIZER POD SYSTEMS AND METHODS," the contents of which are incorporated herein by reference in their entireties.

FIELD OF THE INVENTION

The present invention relates to vaporizers and in particular to dual airflow vaporizer pods.

BACKGROUND OF THE INVENTION

Vaporizers are typically used to aerosolize liquids or volatile substances contained in solid or semisolid substances. Vaporizers designed for plant-based materials, extracts, and/or oils have recently grown in popularity. During operation, these devices typically require a user to draw air into a chamber of the device where the plant material, extract, and/or oil is heated. This air is then drawn into the user's mouth along with the aerosolized liquids or volatile substances generated by heating the plant material, extract, and/or oil. In such systems, air flow may be hindered or prevented by partial or complete solidification of the plant material, extract, and/or oil. Additionally, air drawn into the user's mouth may be hot, negatively affect the flavor of the inhaled vapor or burning the user's mouth. Accordingly, new and improved vaporizers are needed.

SUMMARY

In various exemplary embodiments, the present invention is directed to a vaporizer pod comprising a reservoir defined by, and disposed within a housing, wherein the housing defines a central channel extending between a central channel inlet and a central channel outlet, a column disposed within the housing, an atomizer channel extending between an atomizer channel inlet and an atomizer channel outlet, and a heat conductor disposed within the column.

In various embodiments, the heat conductor is disposed vertically relative to the column. In various embodiments, the central channel is not in fluid communication with the atomizer channel. In various embodiments, the atomizer channel is defined by the housing and the column. In various embodiments, the central channel outlet and the atomizer channel outlet are disposed in a mouthpiece.

In various embodiments, the vaporizer pod further comprises a fill plug coupled to and disposed at least partially within a till aperture defined by the housing. In various embodiments, the vaporizer pod further comprises a wedge disposed in the reservoir. In various embodiments, a base portion of the housing defines at least a portion of the reservoir, and wherein the column is disposed at least partially within the base portion. In various embodiments, the reservoir is in fluid communication with the heat conductor through a first fluid port defined by the column. In various embodiments, the atomizer channel inlet is in fluid communication with the atomizer channel outlet through a second fluid port defined by the column.

In various exemplary embodiments, the present invention is directed to a vaporizer pod comprising a reservoir defined by, and disposed within a housing, wherein the housing comprises a central channel inlet, a central channel outlet, and a central channel disposed therebetween and defined by the housing, and an atomizer channel inlet, an atomizer channel outlet, and an atomizer channel disposed therebetween and defined by the housing and a column disposed within the housing, wherein the central channel outlet and the atomizer channel outlet are disposed in a mouthpiece, a heat conductor disposed within the column, wherein the heat conductor is in fluid communication with the reservoir and in electrical communication with a contact, and a fill plug coupled to and disposed at least partially within a fill aperture defined by a side wall of the housing.

In various exemplary embodiments, the present invention is directed to a vaporizer pod comprising a battery in electrical communication with a contact of a vaporizer pod, wherein the vaporizer pod comprises, a reservoir defined by, and disposed within a housing, wherein the housing defines a central channel extending between a central channel inlet and a central channel outlet, a column disposed within the housing, an atomizer channel extending between an atomizer channel inlet and an atomizer channel outlet, and a heat conductor disposed within the column.

In various embodiments, the atomizer channel is defined by the housing and the column. In various embodiments, the central channel outlet and the atomizer channel outlet are disposed in a mouthpiece. In various embodiments, the vaporizer further comprises a fill plug coupled to and disposed at least partially within a fill aperture defined by the housing. In various embodiments, the vaporizer further comprises a wedge disposed in the reservoir. In various embodiments, a base portion of the housing defines at least a portion of the reservoir, and wherein the column is disposed at least partially within the base portion. In various embodiments, the reservoir is in fluid communication with the heat conductor through a first fluid port defined by the column. In various embodiments, the atomizer channel inlet is in fluid communication with the atomizer channel outlet through a second fluid port defined by the column. In various embodiments, the contact is in electrical communication with the heat conductor.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION OF THE INVENTION

Figure 1A:
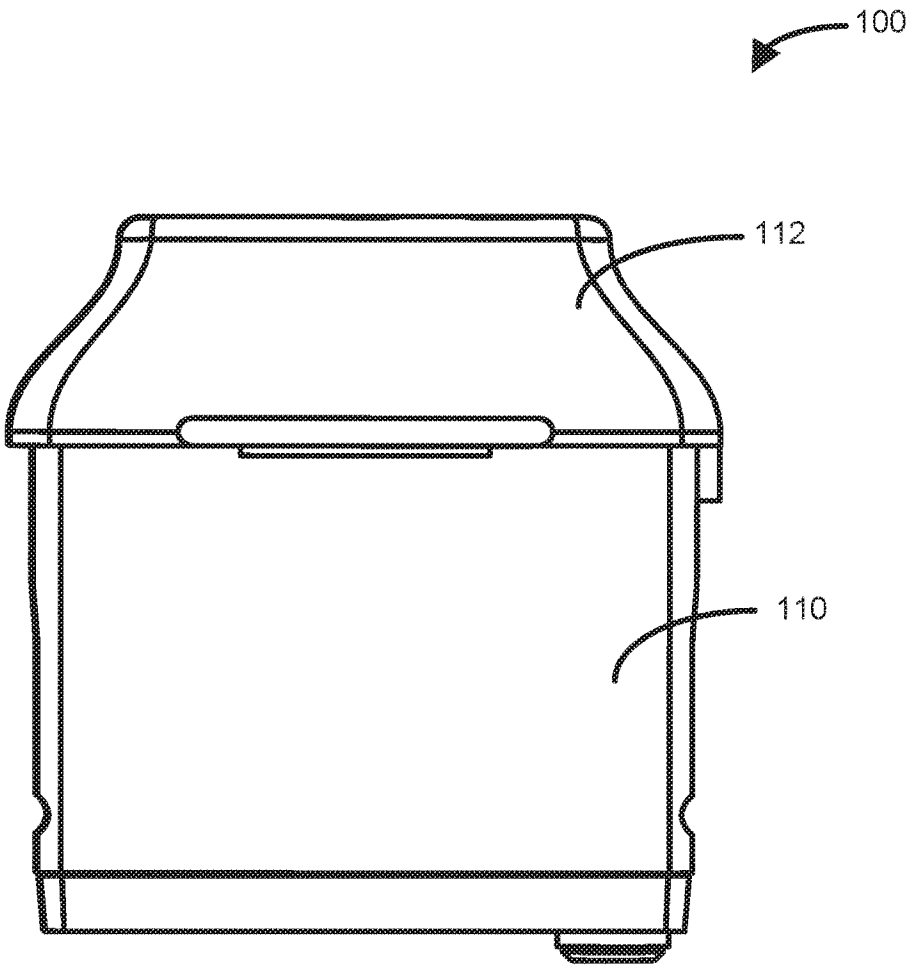
FIGS. 1A-1D illustrate perspective views of a vaporizer pod in accordance with various embodiments.
Figure 1B:
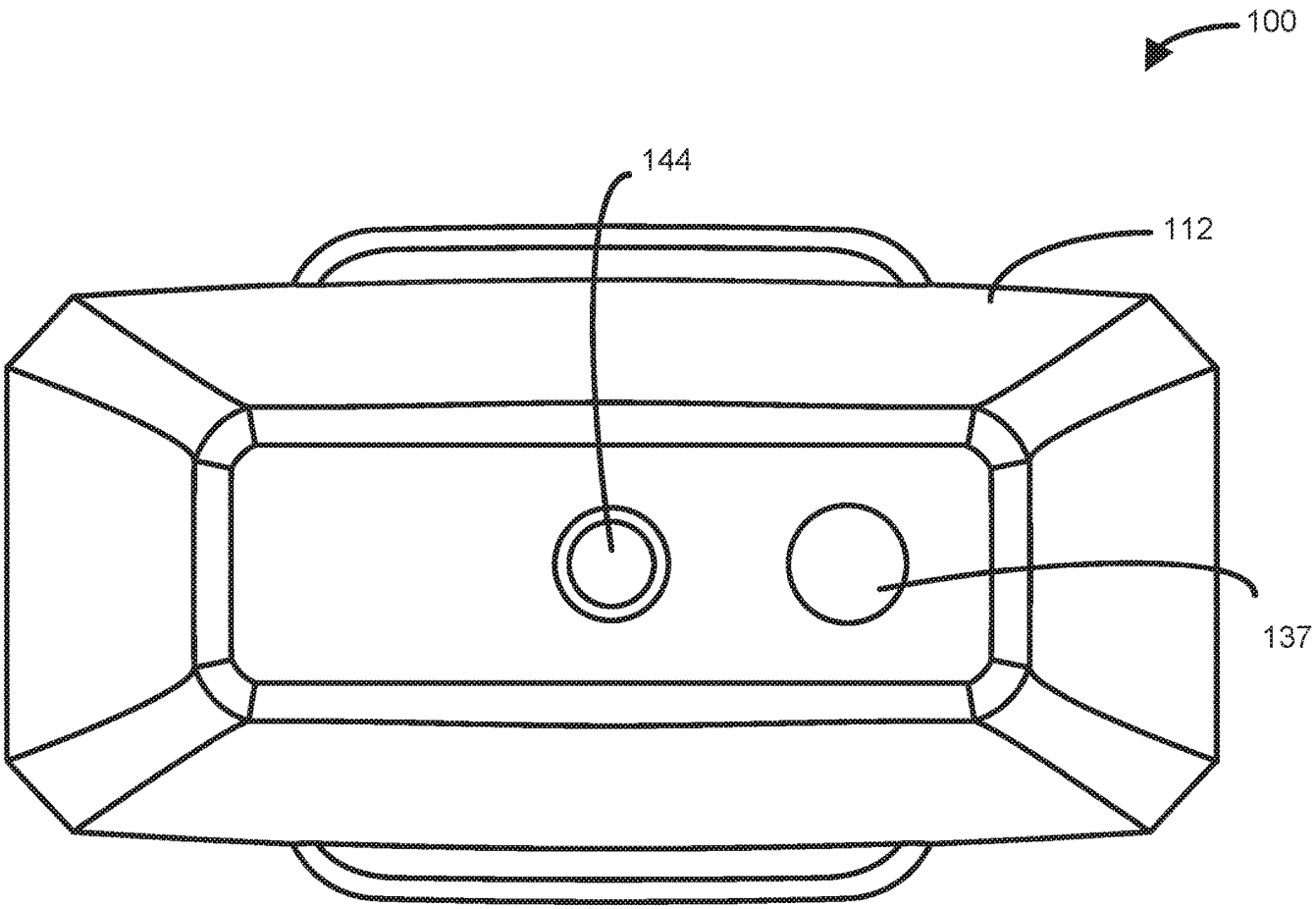
Figure 1C:
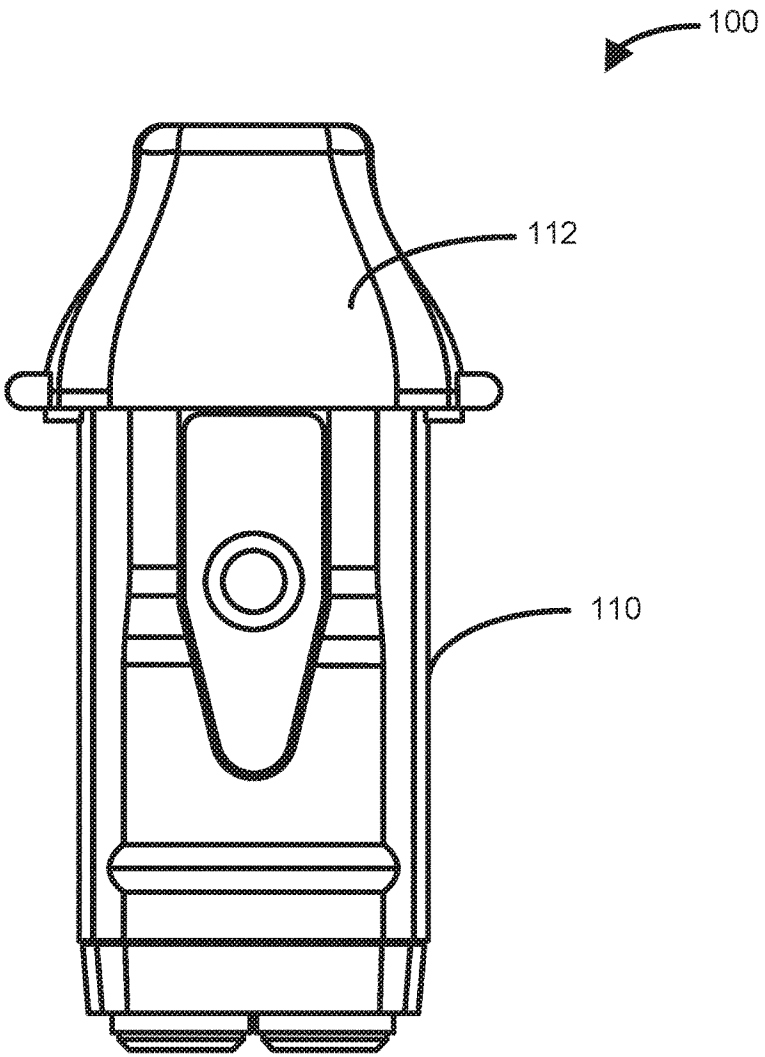
Figure 1D:
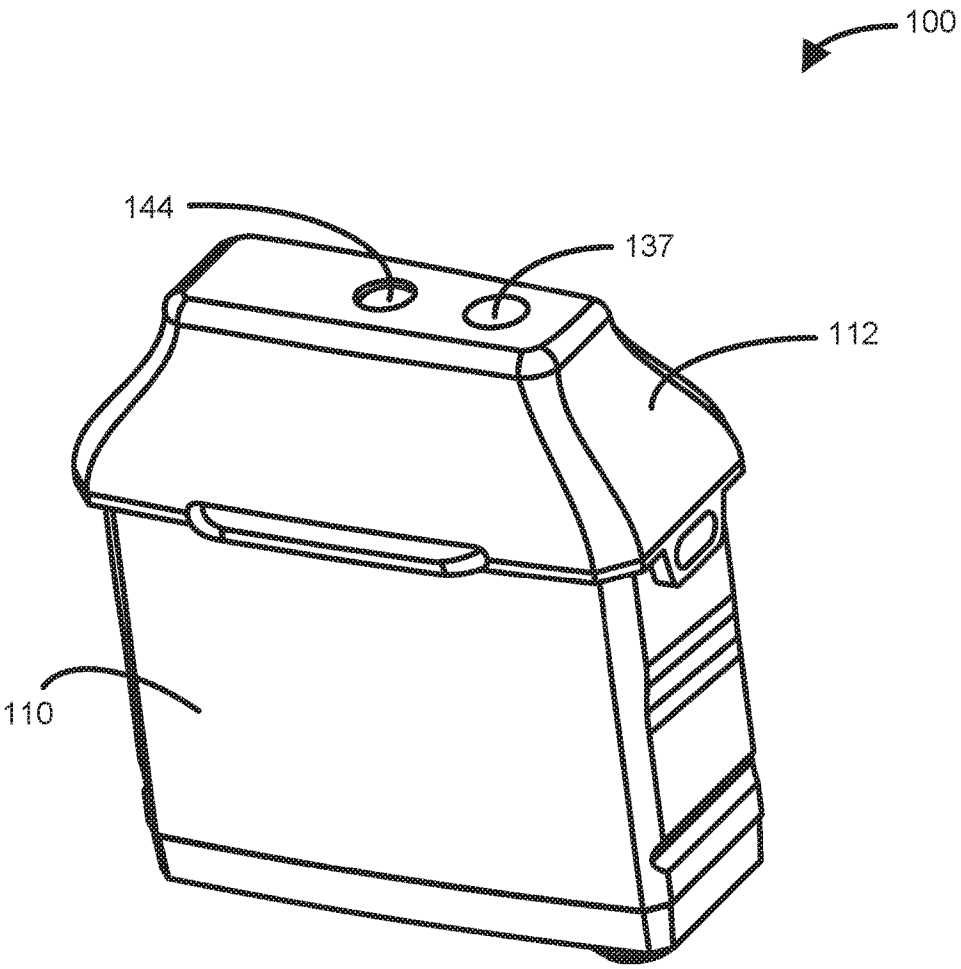
Figure 2:
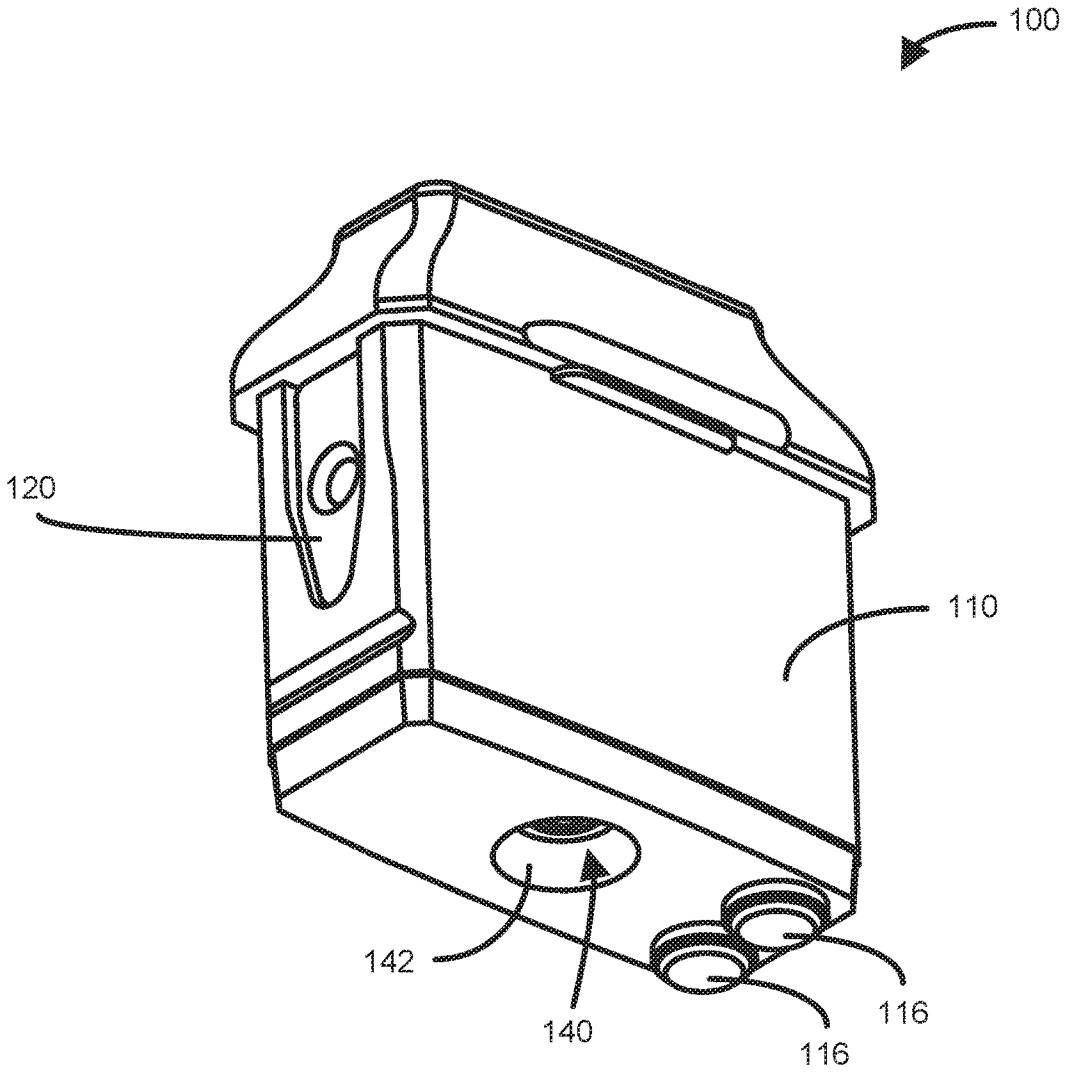
FIGS. 2 and 3 illustrate perspective views of a vaporizer pod in accordance with various embodiments.
Figure 3:
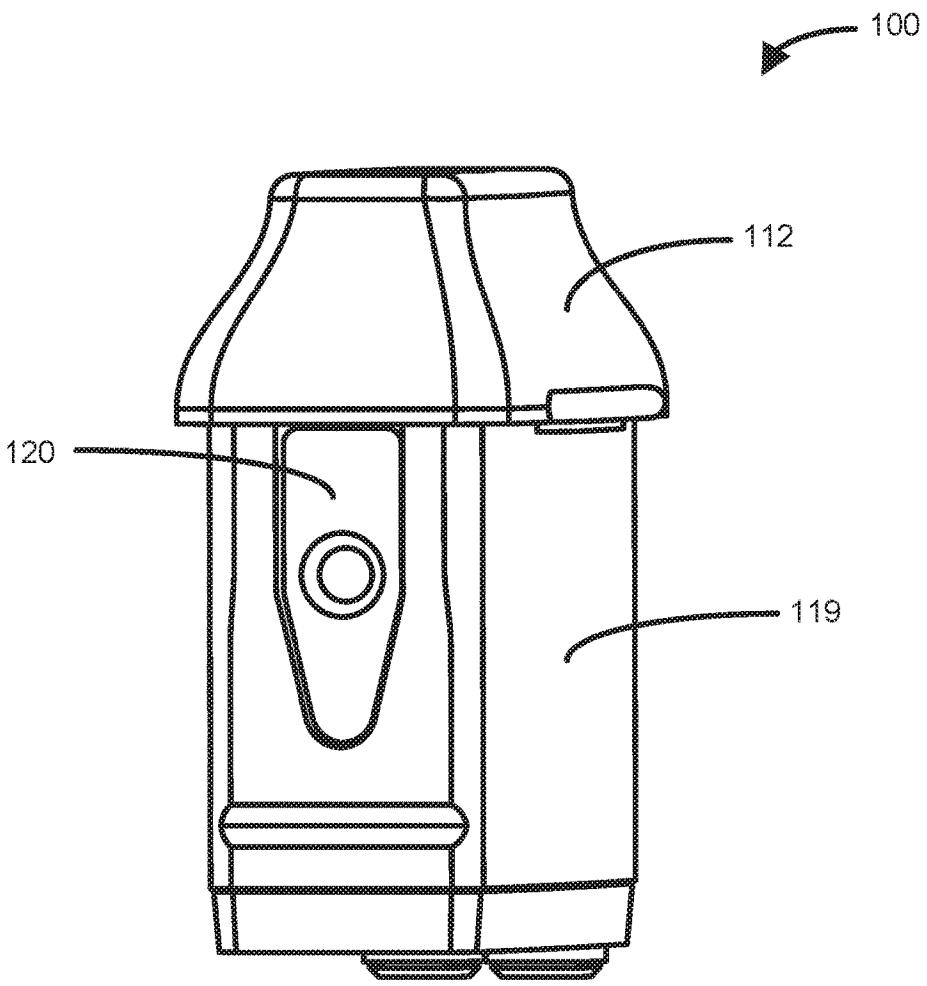
Figure 4:
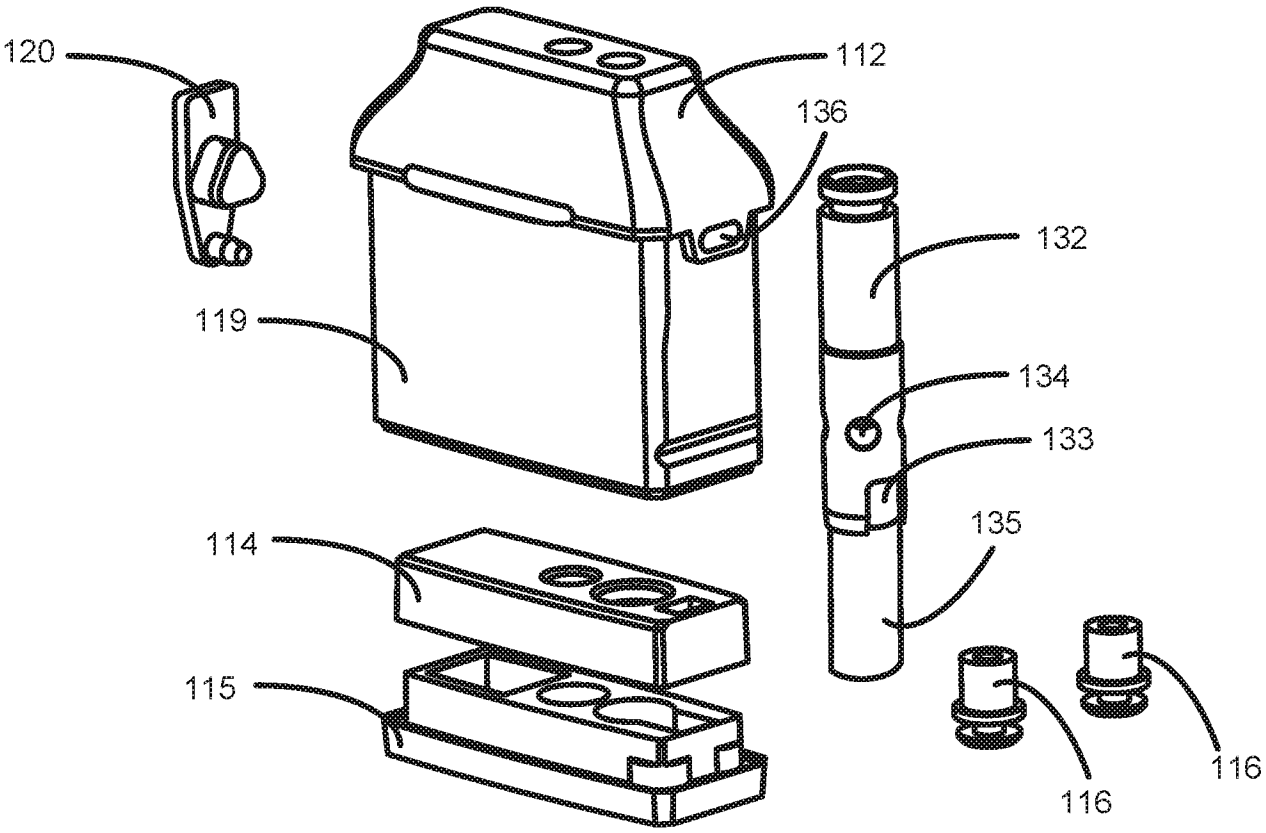
FIG. 4 illustrates an exploded view of various components of a vaporizer pod in accordance with various embodiments.
Figure 5:
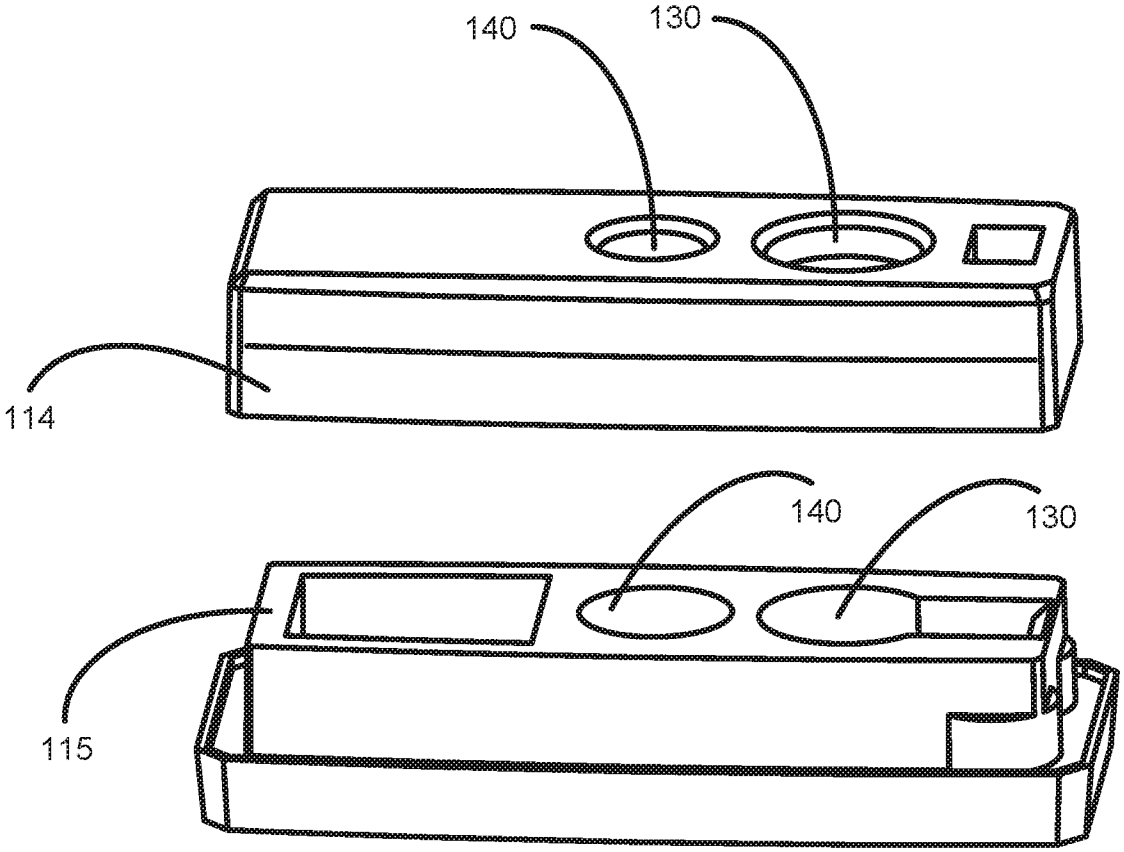
FIG. 5 illustrates an exploded view of a portion of a vaporizer pod in accordance with various embodiments.
Figure 6:
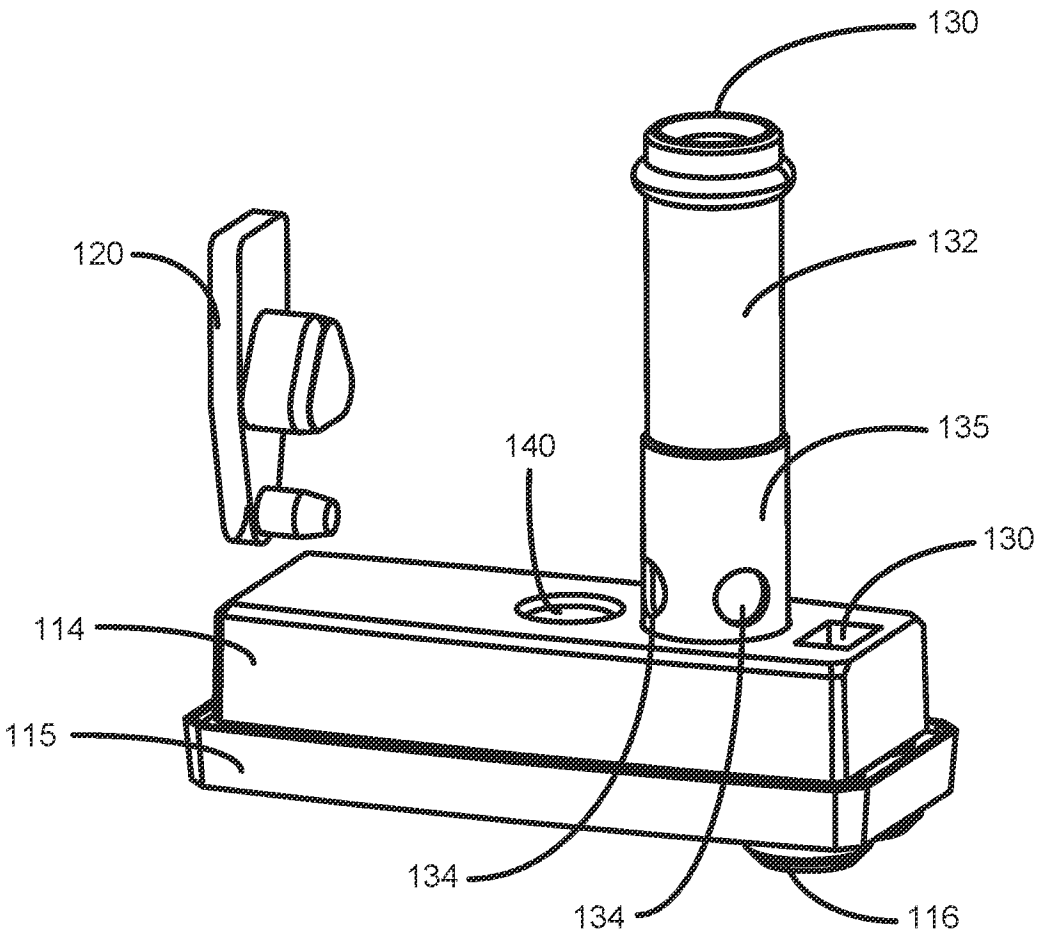
FIG. 6 illustrates a partial perspective view of various components of a vaporizer pod in accordance with various embodiments.
Figure 7:
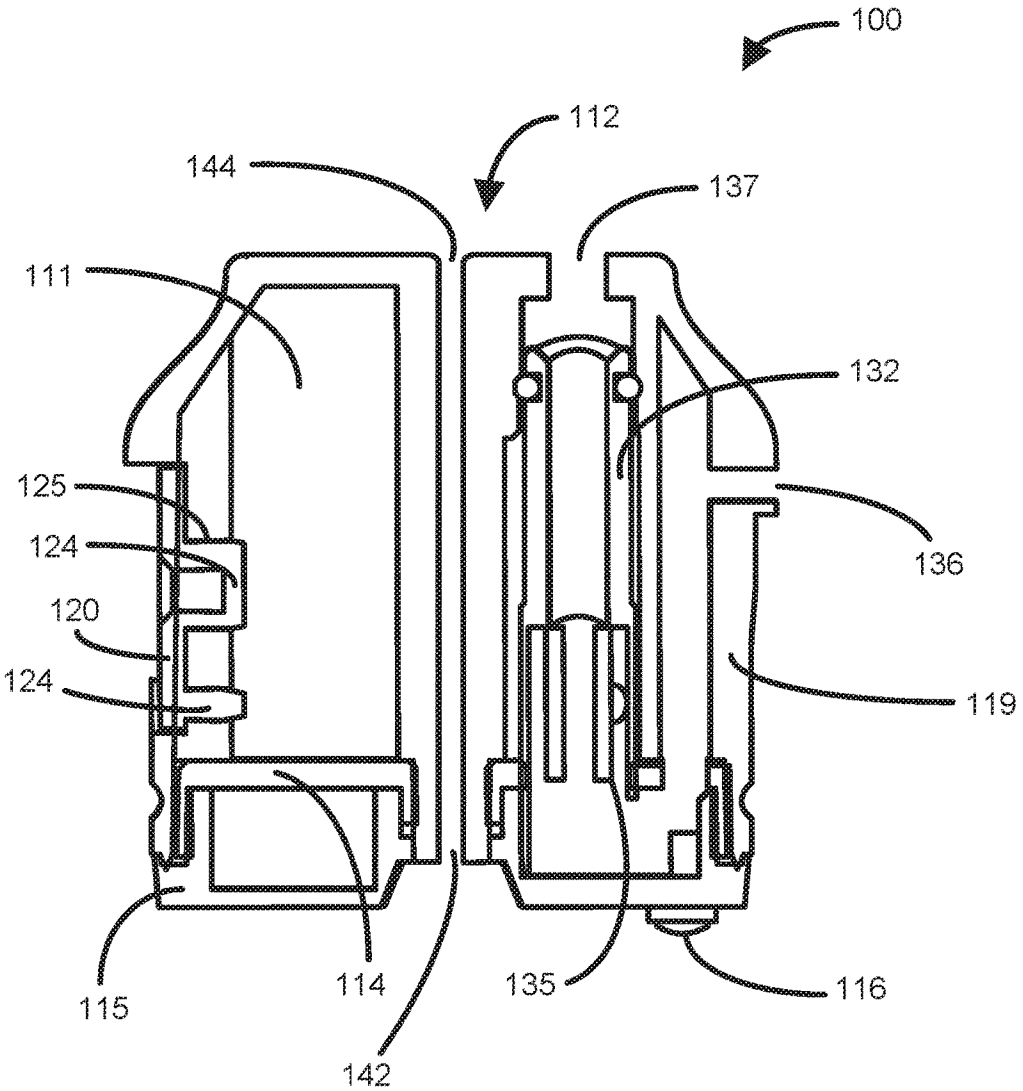
FIG. 7 illustrates a cross section view of a vaporizer pod in accordance with various embodiments.
Figure 8:
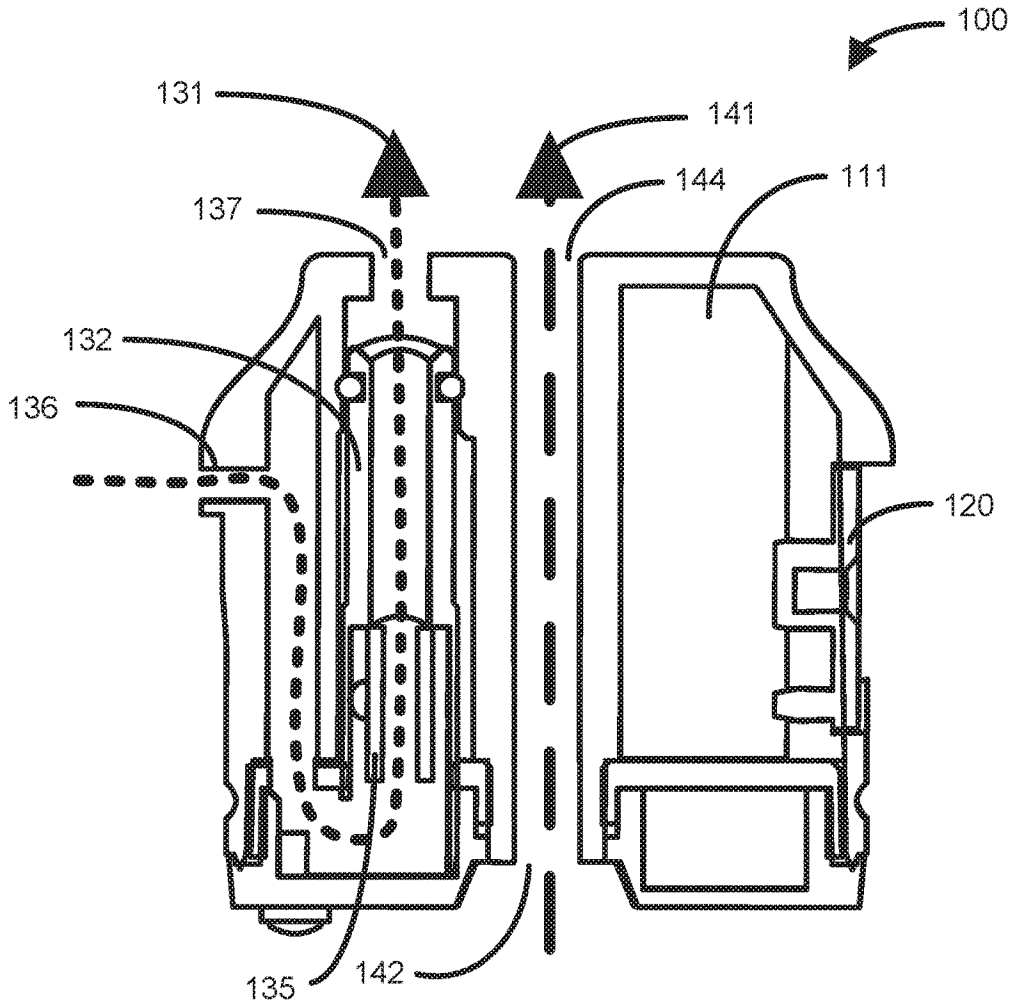
FIG. 8 illustrates a cross section view of a vaporizer pod in accordance with various embodiments.

The following description is of various embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the present disclosure or appended claims.

The detailed description of exemplary embodiments herein makes reference to the accompanying drawings and pictures, which show various embodiments by way of illustration. While these various embodiments are described in sufficient detail to enable those skilled in the art to practice the disclosure, it should be understood that other embodiments may be realized and that logical and/or functional changes may be made without departing from the spirit and scope of the disclosure. Thus, the detailed description herein is presented for purposes of illustration only and not of limitation. Any reference to singular includes plural embodiments, and any reference to more than one component may include a singular embodiment.

Vaporizer systems and devices are provided. In the detailed description herein, references to "an exemplary embodiment." "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

For the sake of brevity, conventional vaporizers and vaporizer components may not be described in detail herein. Furthermore, the connecting lines shown in various figures contained herein are intended to represent exemplary functional relationships and/or physical or communicative couplings between various elements. It should be noted that many alternative or additional functional relationships or physical or communicative connections may be present in a practical vaporizer system.

In various embodiments, a vaporizer pod is disclosed herein. The vaporizer pod may be configured to heat tobacco or other plant materials, extracts, or oils at a temperature such that certain volatile substances contained in the tobacco or other plant material, extract, and/or oil are vaporized without combustion. In various embodiments, the vaporizer pod may be compatible for use in a portable vaporizer, vaporizer pen, desktop vaporizer, or any other suitable type of vaporizer.

The vaporizer pod disclosed herein may be configured to direct two, separated air flows simultaneously into a user's mouth during operation of a vaporizer coupled to the vaporizer pod. A first air flow may communicate ambient air from outside the vaporizer pod, to, near, and/or through a heating element, and subsequently to, near, and/or into a user's mouth. The heating element ray be in contact with a plant material, extract, and/or oil disposed within the vaporizer pod. Application of heat by the heating element may cause evaporation, sublimation, volatilization, or other atomization of all or a portion of the plant material, extract, and/or oil such that it is carried by the heated first air flow to, near, and/or into a user's mouth. A second air flow may communicate ambient air from outside the vaporizer pod, through the vaporizer pod, and to, near, and/or into the user's mouth.

In various embodiments, the second air flow may commingle with the first air flow near or inside the user's mouth. However, the second air flow may commingle with the first air flow inside the vaporizer pod, for example, after the first air flow has been heated by the heating element. In various embodiments, the temperature of the second air flow is lower than the temperature of the heated first air flow, and commingling of the air flow lowers the temperature of a vapor inside and/or entering the user's mouth. In various embodiments, vapor comprising a lower temperature has an improved taste relative to vapor comprising a higher temperature. In various embodiments, lower temperature of the vapor prevents burning of, and/or discomfort to, the user's lips, tongue, gums, teeth, cheeks, and/or mouth.

In various embodiments, simultaneous communication of two, separated air flows to the user's mouth allows the user to take a larger volume of vapor in a single drag. Larger drag volume may improve the taste of the vapor relative to smaller drag volume. Larger drag volume may allow the vapor to contact more portions of the user's lips, tongue, cheeks, and/or mouth than smaller drag volume. Larger drag volume may allow the user inhale vapor more deeply than smaller drag volume. For example, larger drag volume may allow the user, at his or her option, to take a direct lung inhale (for example, inhaling vapor directly into the lungs) and/or to take a mouth to lung inhale (for example, sucking vapor into the mouth and subsequently opening the mouth as the vapor and ambient air are inhaled). In various embodiments, optional election of mouth to lung inhalation or direct lung inhalation may be beneficial for users habituated to cigarettes or cigars, for new vaporizer users, and/or for individuals with impaired lung capacity or hyperinflation of the lungs.

Certain plant materials, extracts, and/or oils suitable for use in vaporizer pods may be thick, viscous, solid and/or semisolid at ambient temperature. After such plant materials, extracts, and/or oils are disposed in a vaporizer pod, they may collect at or near a heating element and, because they are thick, viscous, solid, and/or semisolid, may restrict or prevent communication of air through the vaporizer pod and/or into the user's mouth. The vaporizer pod disclosed herein may continue to communicate air through the vaporizer pod and/or into the user's mouth via the second air flow, even when plant materials, extracts, and/or oils disposed within the vaporizer pod become thick, viscous, solid, and/or semisolid.

In various embodiments, the vaporizer pod and/or the vaporizer to which it is coupled comprises a pressure sensor. Communication of the second air flow through the vaporizer pod (for example, when a user takes a drag from the vaporizer pod) may be detected by the pressure sensor. The pressure sensor may send a signal to a processor and/or a controller that causes a heating element of the vaporizer pod to heat up. An increase in temperature of the heating element may cause the plant materials, extracts, and/or oils—which may be obstructing communication of the first air flow to heat and become more liquid and/or less viscous. In this way, heating of plant materials, extracts, and/or oils disposed within the vaporizer pod may be activated through ordinary operation of the vaporizer pod, namely, when a user takes a drag from the vaporizer pod.

In various embodiments and with reference to FIGS. 1-10, a vaporizer pod 100 comprises a housing 110. Housing 110 may be configured to receive plant materials, extracts, and/or oils into a reservoir 111 defined by housing 110. In various embodiments, housing 110 comprises a generally prismatic shape. However, in various embodiments, the housing may comprise a cuboidal shape, spherical shape, conical shape, pyramidal shape, or any other shape suitable for defining a reservoir. In various embodiments, housing 110 comprises a shape complementary to the shape of a vaporizer, such that vaporizer pod 100 may be disposed at least partially in, or otherwise coupled to, the vaporizer.

Housing 110 may comprise component parts. For example, in various embodiments, housing 110 comprises a mouthpiece 112, an upper portion 119, and/or one or more base portions (114, 115). However, in various embodiments, the housing is integral.

Mouthpiece 112 may be coupled to, and/or comprise a portion of, housing 110. In various embodiments, mouthpiece 112 comprises a contact portion that is configured to be in contact with a user's mouth. A central channel outlet 144 may be disposed on, and defined by, mouthpiece 112. An atomizer channel outlet 137 may be disposed on, and defined by, mouthpiece 112. Central channel outlet 144 and atomizer channel outlet 137 may be disposed in close proximity to one another on mouthpiece 112, such that central channel outlet 144 and atomizer channel outlet 137 are configured to be placed in a user's mouth simultaneously. In various embodiments, for example, when the second air flow and the first air flow are commingled inside the vaporizer pod the central channel outlet and the atomizer channel outlet may comprise the same aperture defined in the mouthpiece. In various embodiments, central channel outlet 144 and atomizer channel outlet 137 are disposed in a top surface of mouthpiece 112. However, central channel outlet 144 and atomizer channel outlet 137 may be disposed on any suitable surface or portion of housing 110.

In various embodiments, vaporizer pod 100 is configured to communicate a central air flow 141 (e.g., a second air flow) from a central channel inlet 142, through a central channel 140, to and through central channel outlet 144, and out of vaporizer pod 100. Central channel inlet 142 may be disposed on, and defined by, housing 110. In various embodiments, central channel inlet 142 is disposed on, and defined by, a second base portion 115 of housing 110. Central channel inlet 142 may be disposed in a bottom surface of housing 110. However, central channel inlet 142 may be disposed on any suitable portion of housing 110.

Housing 110 and/or a base portion (114, 115) thereof may define a portion of central channel 140. Central channel 140 may comprise a channel, tube, hollow cylinder, hose, or other conduit configured to communicate ambient air through vaporizer pod 100, as generally illustrated in the accompanying figures as central air flow 141, and out of vaporizer pod 100 via central channel outlet 144. In various embodiments, ambient air communicated via central air flow 141 does not contact any portion of vaporizer pod 100 other than housing 110 and/or central channel 140 defined thereby. Stated differently, the composition and other characteristics (for example, temperature, humidity, etc.) of ambient air entering central channel inlet 142 may be generally unchanged as it travels rough central channel 140 and exits central channel outlet 144. In various embodiments, however, ambient air may be commingled with heated air and/or vapor from an atomizer air flow (hereinafter described) just before entering a user's mouth.

In various embodiments, vaporizer pod 100 is configured to communicate an atomizer air flow 131 (e.g., a first air flow) from an atomizer channel inlet 136, through an atomizer channel 130, to and through atomizer channel outlet 137, and out of vaporizer pod 100. Atomizer channel inlet 136 may be disposed on, and defined by, housing 110. In various embodiments, atomizer channel inlet 136 is disposed on, and defined by, an upper portion 119 of housing 110. Atomizer channel inlet 136 may be disposed in a side surface of upper portion 119. However, atomizer channel inlet 136 may be disposed on any suitable portion of housing 110, upper portion 119, and/or mouthpiece 112.

Housing 110 and/or a base portion (114, 115) may define some or all of atomizer channel 130. Atomizer channel 130 may comprise a channel, tube, hollow cylinder, hose, or other conduit configured to communicate ambient air through vaporizer pod 100, as generally illustrated in the accompanying figures as atomizer air flow 131, and out of vaporizer pod 100 via atomizer channel outlet 137.

In various embodiments, at least a portion of atomizer channel 130 is defined by a column 132. Column 132 may be at least partially disposed in reservoir 111 and may be configured to at leak partially segregate reservoir 111 from atomizer channel 130. In various embodiments, column 132 is configured to facilitate contact between ambient air communicated via atomizer air flow 131 and plant materials, extracts, and/or oils disposed generally within vaporizer pod 100. Column 132 may further be configured to receive a heat conductor 135 and facilitate contact between heat conductor 135 and plant materials, extracts, or oils disposed generally within vaporizer pod 100. Column 132 may generally comprise a hollow cylindrical shape. However, column 132 may comprise any shape suitable for use in vaporizer pod 100.

Heat conductor 135 may be disposed at least partially within column 132. In various embodiments, heat conductor comprises a generally cylindrical, tubular, or helical shape, such that fluid (for example, air, vapor, liquids, and the like) may generally pass through heat conductor 135 from a first end to a second end. Heat conductor 135 may be disposed vertically relative to column 132 and/or vaporizer pod 100. Stated differently, heat conductor 135 may comprise a central axis generally parallel to, and/or shared with, a central axis of column 132. In various embodiments, heat conductor comprises a material that is sufficiently porous such that fluid (for example, air, vapor, liquids, and the like) may generally pass through heat conductor 135 from a first end to a second end. However, heat conductor 135 may comprise any shape or material suitable for use in vaporizer pod 100.

In various embodiments, ambient air drawn through atomizer channel inlet 136 enters a portion of housing 110 that is segregated from reservoir 111. In various embodiments, as ambient air is communicated along atomizer air flow 131, it is brought into contact with and enters a bottom end of column 132 and/or heat conductor 135. As the ambient air is communicated through and/or brought into contact with heat conductor 135, it may be commingled with all or a portion of the plant material, extract, and/or oil that has evaporated, sublimated, volatilized, and/or otherwise atomized. A vapor that results from such commingling is then communicated through a top end of heat conductor 135 and/or column 132, and is further communicated through atomizer channel outlet 137.

In various embodiments, column 132 comprises a first fluid port 133. First fluid port 133 may comprise an aperture, opening, slot, hole, or the like disposed on and defined by a sidewall of column 132. First fluid port 133 may be configured to interface with one or more portions of housing 110 (for example, base portions 114, 115) so as to direct the communication of ambient air into a bottom end of heat conductor 135.

In various embodiments, column 132 comprises one or more second fluid ports 134. Second fluid port 134 may comprise an aperture, opening, slot, hole, or the like disposed on and defined by a sidewall of column 132. In various embodiments, second fluid port 134 is disposed above first fluid port 133. In various embodiments, second fluid port 134 is disposed above first base portion 114. Second fluid port 134 may be configured to allow communication of plant materials, extracts, and/or oils from reservoir 111, into column 132, and into contact with heat conductor 135.

Heat conductor 135 may be configured to receive an electrical current from a power source, such as a battery, electric socket, electric generator, or the like. Heat conductor 135 may be configured to transfer heat to a plant material, extract, and/or oil disposed in vaporizer pod 100. In various embodiments, heat conductor 135 comprises a wire. In various embodiments, the length of the wire is determined by the size and/or shape of column 132. The length of the wire may be the maximum length capable of being disposed within column 132. In various embodiments, the wire may be oriented within column 132 to form a coil. However, the wire may be oriented within column 132 to form a zig-zag pattern, hairpin pattern, or any other pattern suitable for disposing the wire in column 132. The wire may comprise a diameter of between about 3.26 mm and about 0.07 mm (8 gauge to 40 gauge). The wire may comprise a 26 gauge wire. The wire may comprise a diameter of about 0.40 mm. However, the wire may comprise any diameter suitable for being used in vaporizer pod 100.

In various embodiments, heat conductor 135 comprises a hollow cylindrical shape. In various embodiments, cotton, gauze, a wicking material, and/or a dispersant material is disposed within heat conductor 135. In various embodiments, heat conductor 135 comprises a metal such as titanium, copper, tungsten, aluminum, gold, or nickel. Heat conductor 135 may comprise a metal alloy such as a nickel-chromium alloy, iron-chromium-aluminum alloy, stainless steel, zinc alloy, or any other suitable alloy including commercially-available alloys such as Kanthal® wire produced by the Bulten-Kanthal company of Hallstahammar, Sweden. However, heat conductor 135 may comprise any mineral, metal, alloy, ceramic, composite, or other material suitable for use in vaporizer pod 100. In various embodiments, heat conductor 135 may be selected based on physical properties of vaporizer pod 100. For example, heat conductor 135 may comprise a material having a maximum temperature threshold (based on the voltage applied to it by a power source) below a melting temperature of one or more portions of vaporizer pod 100.

In various embodiments, heat conductor 135 is disposed vertically within column 132 and/or vaporizer pod 100. Stated differently, heat conductor 135 may be disposed with a first end below a second end, and may be configured to communicate a fluid in an upward direction relative to vaporizer pod 100. In various embodiments, vertical disposition and/or orientation may allow heat conductor 135 to be larger and/or longer than would be possible with a horizontal disposition and/or orientation. A larger and/or longer heat conductor may improve and/or increase evaporation, sublimation, volatilization, and/or atomization of plant material, extract, and/or oil. A larger and/or longer heat conductor may improve the flavor of vapor produced by the vaporizer. A larger and/or longer heat conductor may allow the vaporizer to operate at a lower relative temperature.

In various embodiments, heat conductor 135 may be configured to receive a voltage of between about 1.5 V and about 8 V. More preferably, heat conductor 135 may be configured to receive a voltage of between about 2 V and about 5 V. In various embodiments, heat conductor 135 is configured to receive a voltage of about 3 V to about 4 V when the heating assembly is used with concentrated plant extracts, including waxes, shatters, crumbles, dabs, resins, or other concentrates. In various embodiments, heat conductor 135 is configured to receive a voltage of about 2.5 V to about 3.5 V when the heating assembly is used with plant-based oils. However, heat conductor 135 may receive any voltage suitable for use in vaporizer pod 100.

In various embodiments, heat conductor 135 is mechanically and/or electrically coupled to contact 116. Contact 116 may be coupled to and disposed at least partially in housing 110. In various embodiments, contact 116 is coupled to and disposed in a second base portion 115 of housing 110 such that a contact surface of contact 116 is disposed on an outer, bottom surface of housing 110. The contact surface of contact 116 may be configured to interface with, and receive a current from a power source.

Contact 116 may be configured to communicate a current from a power source to heat conductor 135. In various embodiments, contact 116 comprises an electrically conductive pin. Contact 116 may comprise copper. Contact 116 may be electroplated with an electrically conductive material.

In various embodiments, contact 116 comprises gold-plated copper. However, contact 116 may comprise any suitable metal, alloy, or other conductive material, and may be electroplated with any suitable metal, alloy, or other conductive material. In various embodiments, contact 116 may comprise a 510 thread connector, an 808 thread connector, an eGo™ connector, or any other electrical connector suitable to communicate an electrical current from a power source to heat conductor 135.

In various embodiments, vaporizer pod 100 further comprises a fill aperture 125 configured to allow a user to fill reservoir 111 with plant materials, extracts, and/or oils. Fill aperture 125 may be disposed on, and defined by, housing 110. In various embodiments, fill aperture 125 is disposed on, and defined by, a side wall of upper portion 119. Fill aperture 125 may comprise a circular, ovoid, square, or any other suitable shape. In various embodiments, fill aperture 125 comprises a shape complimentary to a plug portion 124 of fill plug 120 that is configured to be force fit into fill aperture 125.

Fill plug 120 may further comprise an anchor 122 configured to secure a portion of fill plug 120 to housing 110, while allowing plug portion 124 to be optionally remove from, and replaced within till aperture 125. In various embodiments, fill plug 120 is configured to seal or otherwise prevent fluid from exiting reservoir 111 through fill aperture 125.

Figure 9:
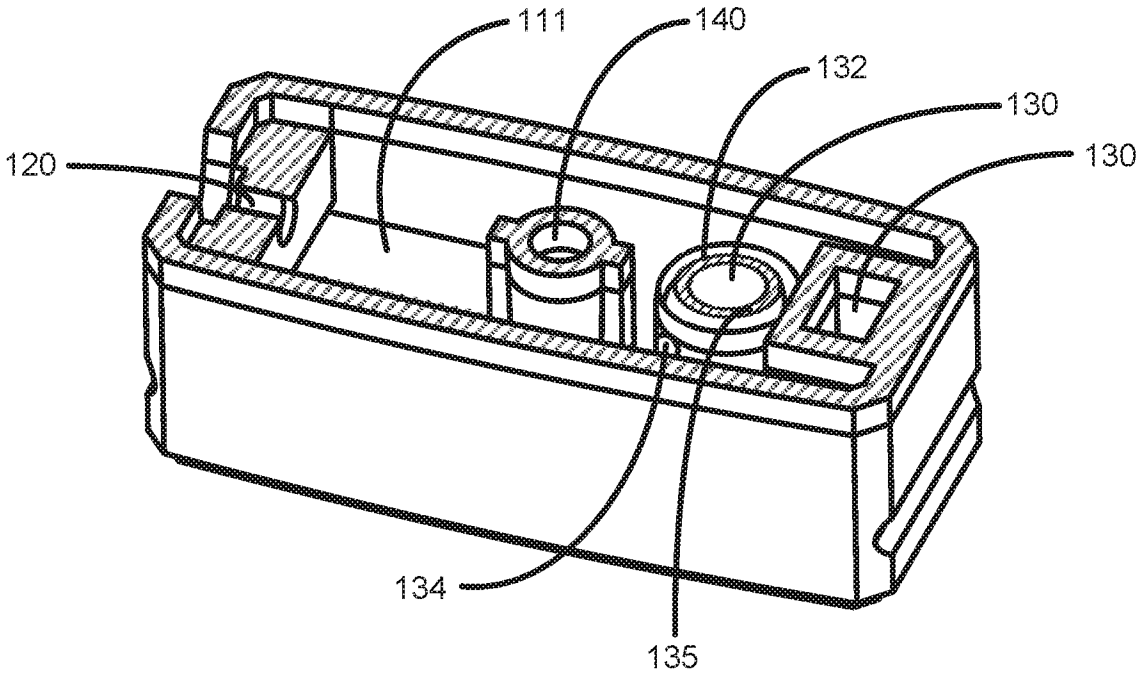
FIG. 9 illustrates a perspective cross section of a vaporizer pod in accordance with various embodiments.
Figure 10:
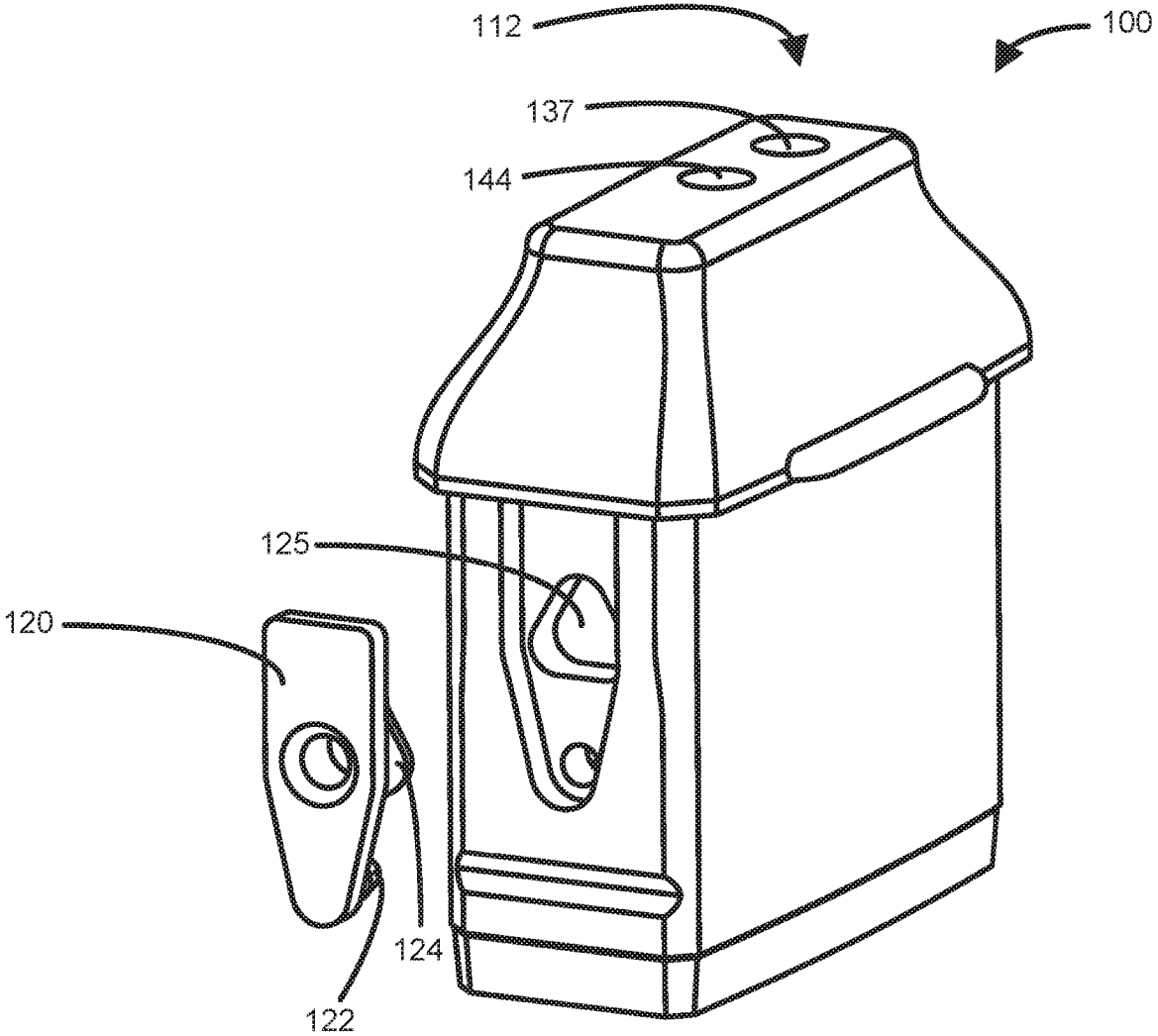
FIG. 10 illustrates an exploded view of various components of a vaporizer pod in accordance with various embodiments.
Figure 11:
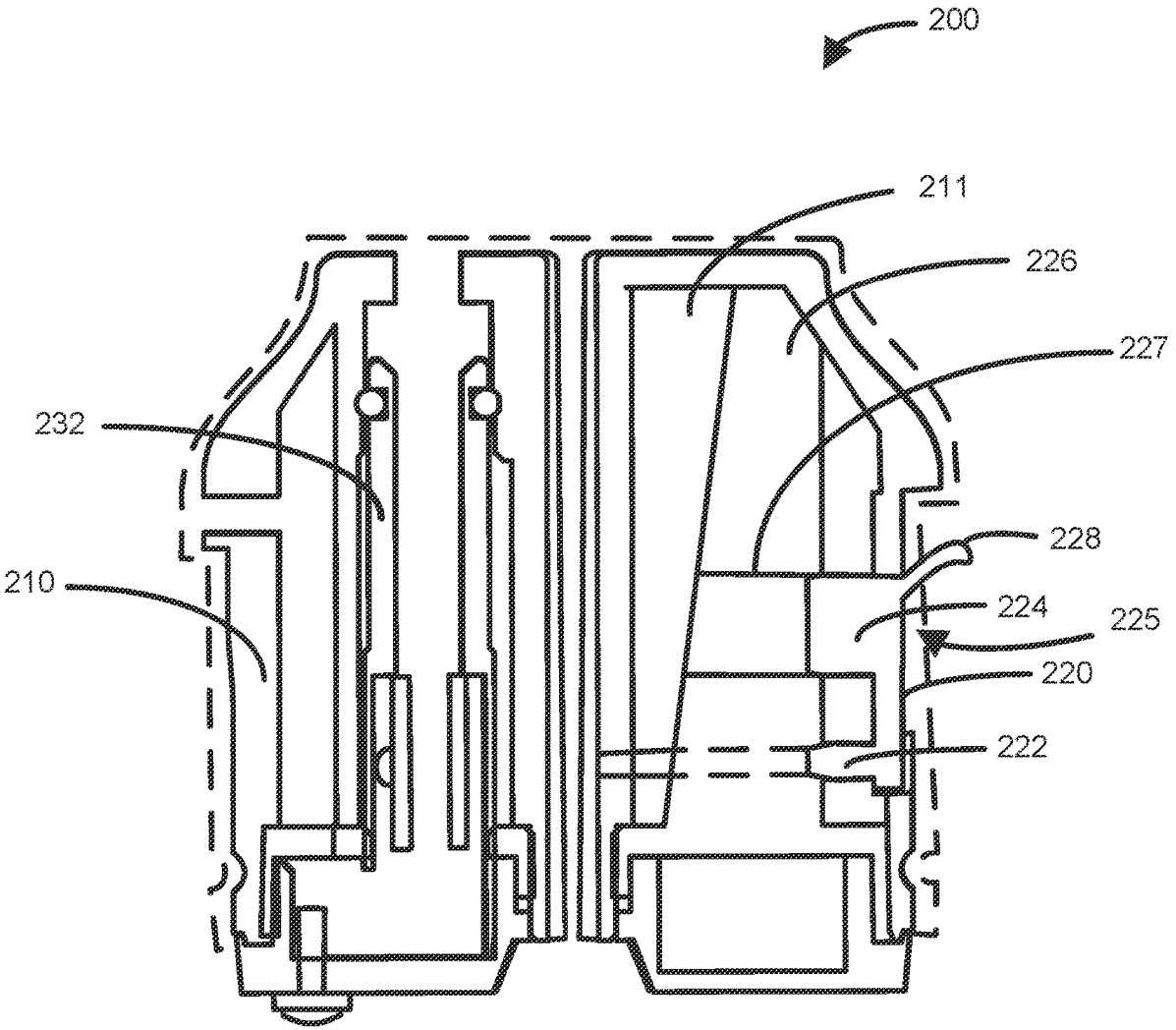
FIG. 11 illustrates a cross section of a vaporizer pod in accordance with various embodiments.

FIG. 9 illustrates an embodiment of the present disclosure. Unless otherwise specified below, the numerical indicators used to refer to components in FIG. 11 are similar to those used to refer to components or features in FIGS. 1-10, except that the index has been incremented by 100. In various embodiments, and with reference to FIG. 11, vaporizer 200 may further comprise a wedge 226. Wedge 226 may be disposed within reservoir 211. In various embodiments, wedge 226 is configured to decrease an available volume of reservoir 211. In various embodiments, wedge 226 may optimize the communication of fluids (for example, plant materials, extracts, and/or oils) from reservoir 211 into column 232, particularly when such fluids are purchased and/or used in relatively small volumes.

In various embodiments, a wedge as described herein may be integral with a fill plug. However, in various embodiments, the wedge is nonintegral with the till plug. In various embodiments, the wedge is disposed in a top portion of a reservoir, such that fluids disposed in the reservoir are prevented and/or limited from contacting a top inner surface of the reservoir. However, the wedge may be disposed in any suitable portion of the reservoir. In various embodiments, the wedge is comprised of a thermoplastic polymer, for example, a polycarbonate. However, the wedge may comprise any plastic, rubber, silicone, metal, alloy, ceramic, composite, or other material suitable for use in a vaporizer as described herein.

In various embodiments, wedge 226 may comprise a wedge aperture 227. Wedge aperture 227 may be defined by, and extend through, wedge 226 and may be disposed in a portion of wedge 226 so as to align with plug portion 224 of fill plug 220. Stated differently, wedge aperture 227 may be configured to allow a user to communicate a fluid from outside vaporizer 200, through fill aperture 225, through wedge aperture 227, and into reservoir 211. In various embodiments, anchor 222 of fill plug 220 may be configured to secure a portion of fill plug 220 to housing 210, while allowing plug portion 224 to be optionally remove from, and replaced within fill aperture 225. Anchor 222 may also be configured to secure wedge 226 against one or more interior surfaces of reservoir 211 so as to prevent movement of wedge and to direct fluid communication towards column 232.

In various embodiments, fill plug 220 may further comprise a tab 228. Tab 228 may comprise a projection, flange, pull, handle or the like. Tab 228 may be configured to allow a user to grasp fill plug 220 and pull in an outward direction so as to remove plug portion 224 from fill aperture 225.

In various embodiments, a vaporizer pod as described herein may be disposed in a vaporizer. The vaporizer may comprise a body configured to partially or completely enclose the vaporizer pod. In various embodiments, the vaporizer further comprises a power source, such as a battery knot shown). In various embodiments, the battery comprises a lithium ion battery. In various embodiments, the battery is rechargeable. However, the battery may comprise an alkaline battery, nickel metal hydride battery, nickel cadmium battery, or any other suitable battery. In various embodiments, the battery comprises between about 200 mAh and about 5000 mAh. However, the battery may comprise any suitable capacity. In various embodiments, the battery is configured to deliver a voltage of between about 2 V and about 5 V.

With reference again to FIGS. 2-9, the battery may be disposed at least partially within the body. The battery may be mechanically and/or electrically coupled to contact 116 of vaporizer pod 100. The battery may be directly coupled to a first end and/or a second end of heat conductor 135. The battery may be indirectly coupled to contact 116 via one or more intervening components of the vaporizer and/or the vaporizer pod 100.

In various embodiments, the battery may be in communication with a controller disposed within the housing. The controller may comprise a programmable circuit board. The controller may comprise a processor configured to implement various logical operations in response to execution of instructions, for example, instructions stored on a non-transitory, tangible, computer-readable medium. In various embodiments, the controller may be configured to provide commands in response to variable and non-variable inputs. Variable inputs may include a voltage applied by the power source and/or a signal provided by a sensor coupled to the vaporizer or a vaporizer pod. For example, in various embodiments, a sensor in fluid communication with central channel 140 is configured to detect a change in air pressure associated with a user's drag of air from the vaporizer pod mouthpiece. In response, the sensor may send a signal to the controller the battery to apply a voltage directly to contact 116 and/or indirectly to heat conductor 135. Non-variable inputs may include the coil material, the coil length, diameter, thickness, or gauge, the reservoir volume, and/or other dimensions and characteristics of the vaporizer pod.

It will be apparent to those skilled in the art that various modifications and variations can be made to the present disclosure without departing from the spirit or scope of the disclosure. Thus, it is intended that the present disclosure cover the modifications and variations of this disclosure provided they come within the scope of the appended claims and their equivalents.

Benefits, other advantages, and solutions to problems have been described herein with regard to specific embodiments. However, the benefits, advantages, solutions to problems, and any element(s) that may cause any benefit, advantage, or solution to occur or become more pronounced are not to be construed as critical, required, or essential features or elements of any or all of the claims.

It should be understood that the detailed description and specific examples, indicating exemplary embodiments, are given for purposes of illustration only and not as limitations. Many changes and modifications may be made without departing from the spirit thereof, and principles of the present disclosure include all such modifications. Corresponding structures, materials, acts, and equivalents of all elements are intended to include any structure, material, or acts for performing the functions in combination with other elements. Reference to an element in the singular is not intended to mean "one and only one" unless explicitly so stated, but rather "one or more." Moreover, when a phrase similar to "at least one of A, B, or C" or "at least one of A, B, and C" is used in the claims or the specification, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A vaporizer pod comprising:

a reservoir defined by, and disposed within a housing, wherein the housing defines a central channel extending between a central channel inlet and a central channel outlet;

a column disposed within the housing;

an atomizer channel extending between an atomizer channel inlet and an atomizer channel outlet, the atomizer channel separated from the central channel; the atomizer channel defined by the housing and the column; and a heat conductor disposed within the column, wherein the central channel outlet and the atomizer channel outlet are disposed in a mouthpiece.

2. The vaporizer pod of claim 1, wherein the heat conductor is disposed vertically relative to the column.

3. The vaporizer pod of claim 1, wherein the central channel is not in fluid communication with the atomizer channel.

4. The vaporizer pod of claim 1, wherein the atomizer channel is defined by the housing and the column.

5. The vaporizer pod of claim 1, further comprising a fill plug coupled to and disposed at least partially within a fill aperture defined by the housing.

6. The vaporizer pod of claim 5, further comprising a wedge disposed in the reservoir.

7. The vaporizer pod of claim 1, wherein a base portion of the housing defines at least a portion of the reservoir, and wherein the column is disposed at least partially within the base portion.

8. The vaporizer pod of claim 7, wherein the reservoir is in fluid communication with the heat conductor through a first fluid port defined by the column.

9. The vaporizer pod of claim 8, wherein the atomizer channel inlet is in fluid communication with the atomizer channel outlet through a second fluid port defined by the column.

10. A vaporizer, comprising a battery in electrical communication with an electrical contact of the vaporizer pod of claim 1.

11. A vaporizer pod comprising:

a reservoir defined by, and disposed within a housing, wherein the housing defines a central channel extending between a central channel inlet and a central channel outlet;

a column disposed within the housing;

an atomizer channel extending between an atomizer channel inlet and an atomizer channel outlet, the atomizer channel separated from the central channel; and a heat conductor disposed within the column, wherein:

a base portion of the housing defines at least a portion of the reservoir, the column is disposed at least partially within the base portion, the reservoir is in fluid communication with the heat conductor through a first fluid port defined by the column, and the atomizer channel inlet is in fluid communication with the atomizer channel outlet through a second fluid port defined by the column.

12. A vaporizer, comprising a battery in electrical communication with an electrical contact of the vaporizer pod of claim 11.

* * * * *